US005533649A

United States Patent [19]

Von Schuckmann

[11] Patent Number: 5,533,649

[45] Date of Patent: Jul. 9, 1996

[54] CLOSURE FOR CONTAINER

[75] Inventor: Alfred E. F. Von Schuckmann, Kevelaer, Germany

[73] Assignee: Courtaulds Packaging Limited, Colchester, Great Britain

[21] Appl. No.: 356,271

[22] Filed: Dec. 20, 1994

[30] Foreign Application Priority Data

Jun. 25, 1992 [GB] United Kingdom ..... 9213534

[51] Int. Cl.[6] ..... B67D 5/33

[52] U.S. Cl. ..... 222/153.14; 222/212; 222/494

[58] Field of Search ..... 222/153.14, 212, 222/491, 494, 497, 502, 522, 525, 545, 563, 568

[56] References Cited

U.S. PATENT DOCUMENTS

| | | | |
|---|---|---|---|
| 5,161,718 | 11/1992 | Gueret | 222/494 |
| 5,199,617 | 4/1993 | Bennett | 222/498 |

FOREIGN PATENT DOCUMENTS

| | | | |
|---|---|---|---|
| 0452196A1 | 4/1991 | European Pat. Off. . | |
| 794714 | 2/1936 | France . | |
| 632462 | 12/1978 | Switzerland . | |
| 925195 | 5/1963 | United Kingdom . | |
| 2098958 | 12/1982 | United Kingdom . | |
| 94/027883 | 12/1994 | WIPO | 222/494 |

*Primary Examiner*—Andres Kashnikow
*Assistant Examiner*—Philippe Deigkshani
*Attorney, Agent, or Firm*—Howson and Howson

[57] ABSTRACT

A dispensing closure device for sealing engagement over the mouth of a container comprises a body with an orifice therethrough, a stopper mounted on the body positionable within the orifice and a cap movable relative to the body between open and closed positions. The cap has a closure, e.g. in the form of a cam, for retaining the stopper in an orifice-closing position when the cap is in its closed position and for enabling the stopper to move out of its orifice-closing position when the cap is in its open position. The stopper is resiliently biased away from its orifice-closing position.

15 Claims, 3 Drawing Sheets

CLOSURE FOR CONTAINER

TECHNICAL FIELD

This invention relates to a dispensing closure device of the kind specified in the pre-characterising part of the claim 1. Such closure devices are suitable in particular, although not exclusively, as closures for use on flexible wall containers in which the contents are dispensed by squeezing the walls of the container. An example of such a container is a container intended to be used in a shower which is intended to be used in an inverted position for dispensing soap, shampoo and/or conditioner.

With containers that are normally used inverted for dispensing products such as shower gels, liquid soaps, shampoo, and other liquid or paste-like substances, there is a need for an easy to use, non-drip closure. In particular there is a need for a closure which when in the "open" position still retains the contents of the container without dripping but which allows the contents to be dispensed by subjecting the contents to pressure (e.g. by squeezing the container).

BACKGROUND ART

A known closure device of the kind specified in the pre-characterising part of claim 1 is disclosed in GB-A-925, 195. In this known closure device the stopper comprises a closure valve which is not connected to the body or cap. The closure valve has resilient fingers which are resiliently deflected so as to urge the closure valve into a position closing the orifice within the body.

DISCLOSURE OF THE INVENTION

An object of the present invention is to provide a closure which is easy to open and close, but which in the "open" position has a reduced tendency to drip compared with other prior known devices.

According to the present invention a dispensing closure device according to the pre-characterising part of claim 1, is characterised in that the stopper is mounted on the body and is resiliently biased towards a position in which it does not stop the orifice and in that said closure means comprises cam means for acting on the stopper during movement of the cap into its closed position to urge the stopper into its orifice sealing position in opposition to the resilient biasing.

The resilient biasing may be effected by moulding the stopper from resiliently deformable material and moulding it in a position where it projects in a direction which extends away from the body. The bias is achieved by the resilience of the material acting against the action of the cap bending the stopper to its operational positions. Alternatively, the bias may be achieved by pivotally mounting the stopper on the body, and either relying on a biasing means such as, for example, a spring or an elastically deformable body, or by relying on the pressure of the fluid in the container to act on the stopper to urge it towards a position where the stopper opens the orifice.

Preferably the stopper comprises an obturator head dimensioned and positioned relative to the orifice so as to be able to seal off the orifice when the cap is in the closed position, and being mounted on at least one resiliently deflectable member attached to the body. The resiliently deflectable member is typically made of resilient material but typically is joined to the body by a weakened portion acting as a stopper hinge.

In a preferred embodiment of the invention in which the stopper has an obturator head, the cam means has a first cam surface which contacts the head when the cap is moved into the closed position to urge the head into sealing engagement in the orifice, and a second cam surface which contacts the at least one resiliently deflectable member when the cap is in the open position to hold the stopper in a position where the head obturates the orifice but which enables the resiliently deflectable member to resiliently deflect and move the head out of contact with the orifice to open the orifice when the head is subjected to fluid pressure from within the container above a predetermined pressure.

The body may comprise a substantially cylindrical portion having means for fastening the body to the container and an end wall in which the orifice is eccentrically located relative to the longitudinal axis of the cylindrical portion, the stopper being mounted on the end wall eccentrically relative to the said longitudinal axis.

Preferably the cap comprises a cylindrical wall portion and an end wall having an outlet opening therein and provided with an internal cylindrical flange which is located concentrically with respect to the orifice.

In the preferred embodiment, the cap is turnable relative to the body between its open and closed positions, the body being cylindrical about the axis of rotation of the cap and being provided with a circumferentially extending groove, and the cap being cylindrical and provided with a flange which engages the groove to hold the cap in place on the body.

In the case where the cap is turnable relative to the body, the cam means suitably comprises at least one arcuate camming surface which, when the cap is in the closed position, contacts the head and when the cap is in the open position, contacts the at least one resiliently deflectable member.

Preferably stop means are provided on the cap and on the body to restrict the extent of movement of the cap relative to the body.

The invention also embraces a container having a closure device according to the present invention.

BRIEF DESCRIPTION OF THE DRAWINGS

The invention will now be described, by way of example only, with reference to the accompanying drawings, in which.

BEST MODES FOR CARRYING OUT THE INVENTION

Figure 1:
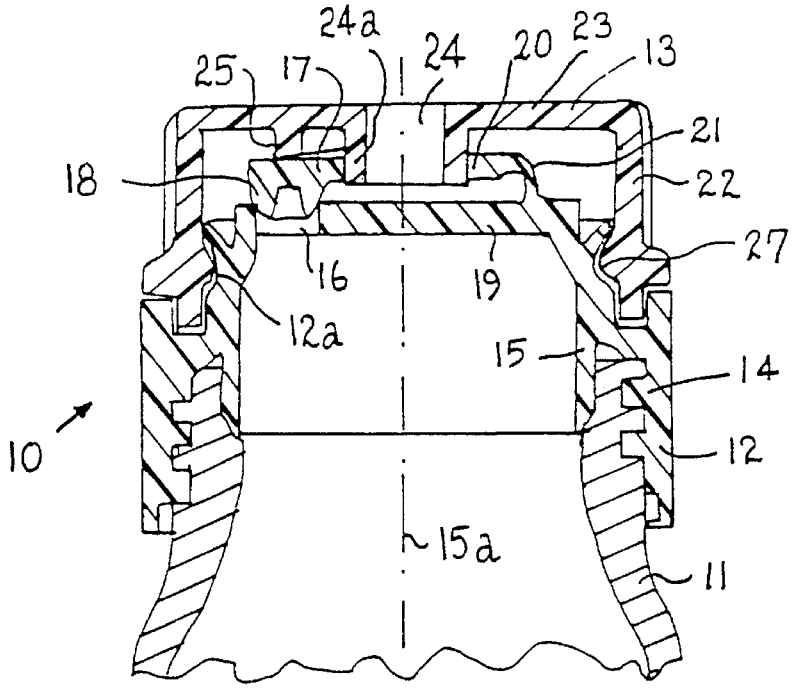
FIG. 1 is a cross-sectional elevation through a closure devide constructed in accordance with the present invention showing the closure device in a closed position.

Referring to the drawings there is shown a closure device, generally designated 10, for mounting on the neck of a flexible wall container 11 which comprises, for example, a plastics bodied squeezable tube which is sealed at its base and has an externally threaded neck. The container 11 is intended to be used in an inverted position to that shown in FIGS. 1 and 2 for dispensing, for example, shower gel.

The closure device 10 is fitted to a neck of a container 11 and comprises two components, namely a body 12 and a rotationally mounted outer cap 13. The body 12 comprises an internally threaded outer portion 14 which carries a thread which is of a complimentary shape to that provided on the neck of the container 11. The body 12 has integrally moulded therewith, a cylindrical portion 15 which forms an internal extension of the neck of the container. The cylindrical portion 15 has an integrally moulded top 19 which is provided with an orifice 16 which is located eccentrically relative to the longitudinal axis 15*a* of the body 12.

Integrally moulded on the body 12 is a stopper 17 which comprises an obturator head 18 joined to the body 12 by a generally triangular shaped web 20 having an aperture 20*a* therein. The web 20 is provided with a thinner or weakened portion adjacent its wider end where it joins the body 12 defining a hinge 21. The stopper 17 is mounted eccentrically relative to the axis 15*a* and the dimensions of the stopper are such that the head 18 is locatable in the orifice 16 so as to close or seal the latter.

Figure 4:
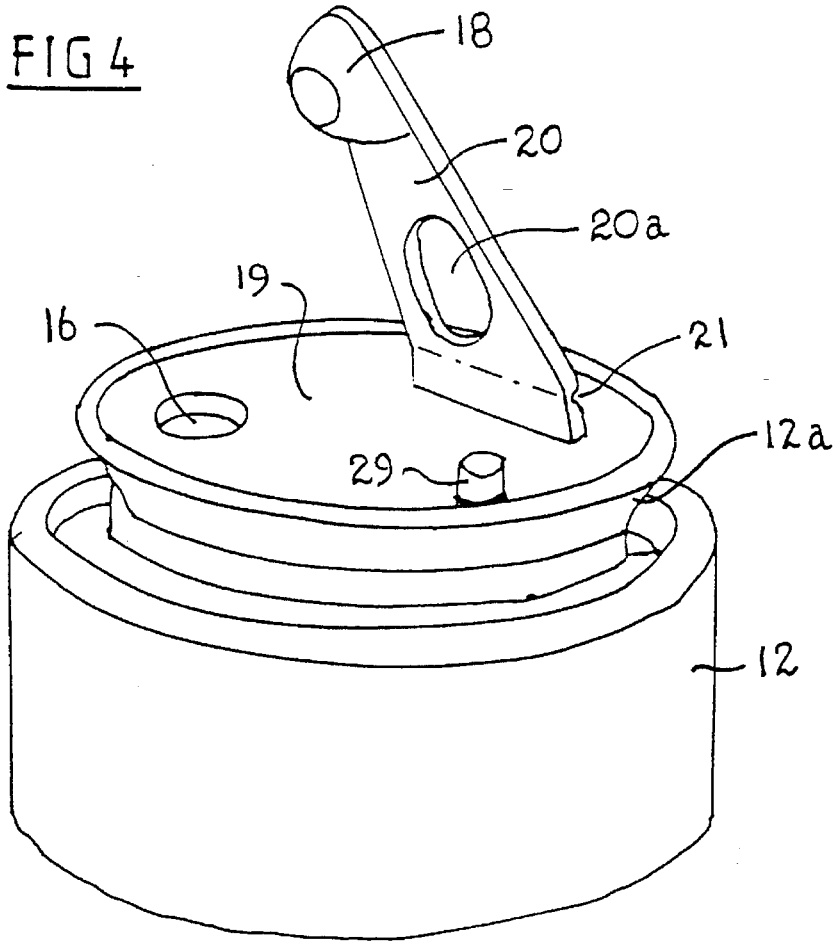
FIG. 4 is an isometric projection of part of the closure device shown in FIGS. 1 and 2, and FIGS. 5 and 6 are views from above showing the relative positions of the cap and body of the closure device when the cap is in closed and open positions, respectively.

The body 12 is moulded from a resiliently deformable material and is moulded so that the natural position of the stopper 17 is approximately as shown in FIG. 4. Hence if the stopper is deflected or bent towards the orifice 16 from the position shown in FIG. 4 the resiliently deflected web 20 biases the stopper back towards the position shown in FIG. 4. Alternatively, the stopper may be biased to the open position by making the hinge 21 freely pivotal relative to the body, and relying on the pressure of the fluid in the container to act on the stopper to bias it to a position where the stopper opens the orifice 16. The body 12 is also provided with a circumferential groove 12*a* around its uppermost lip into which the cap fits.

Figure 3:
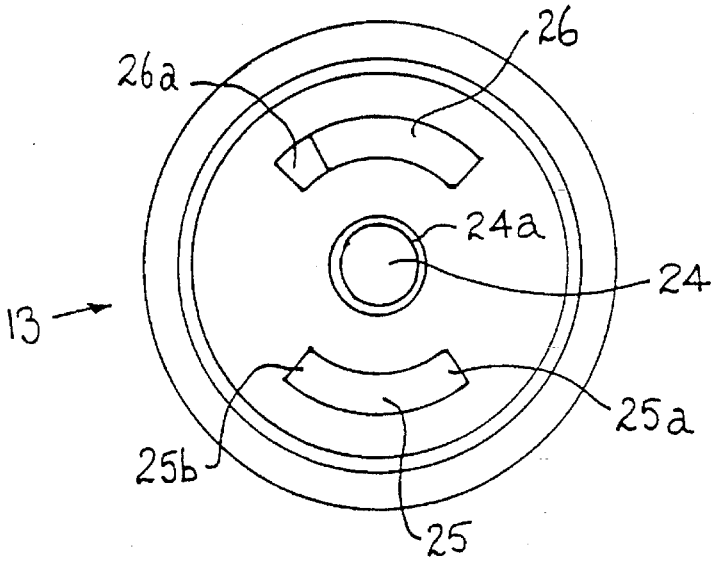
FIG. 3 is a view from below of the inside of a cap which forms part of the closure device shown in FIGS. 1 and 2.

The outer cap 13 comprises a cylindrical wall 22 and an end wall 23. The end wall 23 is provided with an outlet opening 24 coaxial with the cylindrical wall 22 and, on its inside, has cam means comprising an arcuate first cam 25 and an arcuate second cam 26 (see FIG. 3). The cylindrical wall 22 is provided with a radially inwardly extending annular flange 27 which in use interengages with the circumferential groove 12*a*. Hence the cap 13 can be push fitted onto the groove 12*a* but is then free to turn relative to the body 12. The angle of rotation of the cap 13 relative to the body 12 is restricted by means of a stop 29 moulded on the body 12 which cooperates with adjacent ends of the arcuate first and second cams 25 and 26 as described below. The aperture 20*a* ensures that the web 20 does not block the outlet opening 24 in any rotational position of the cap 13.

Figure 2:
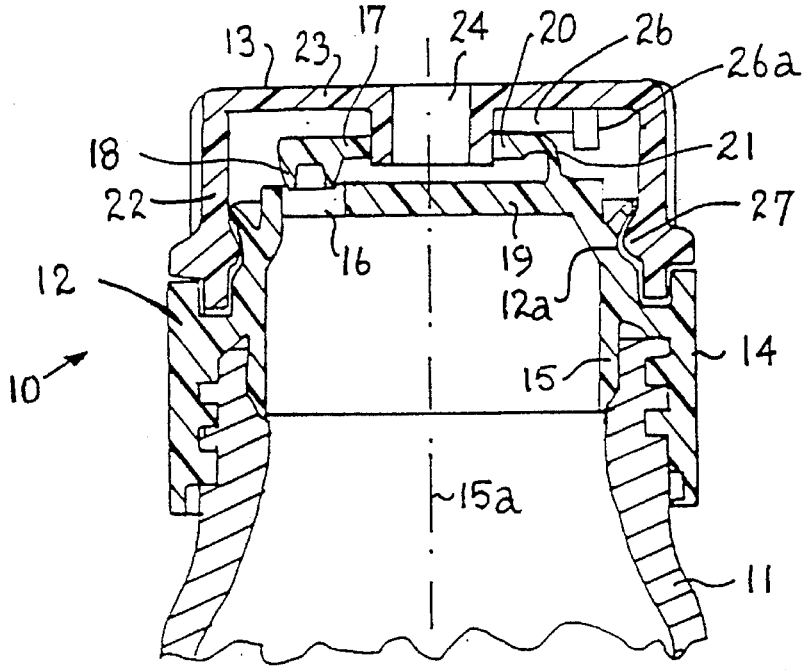
FIG. 2 is a cross-sectional elevation through the same closure device shown in FIG. 1, but showing the closure device in an open position.
Figure 5:
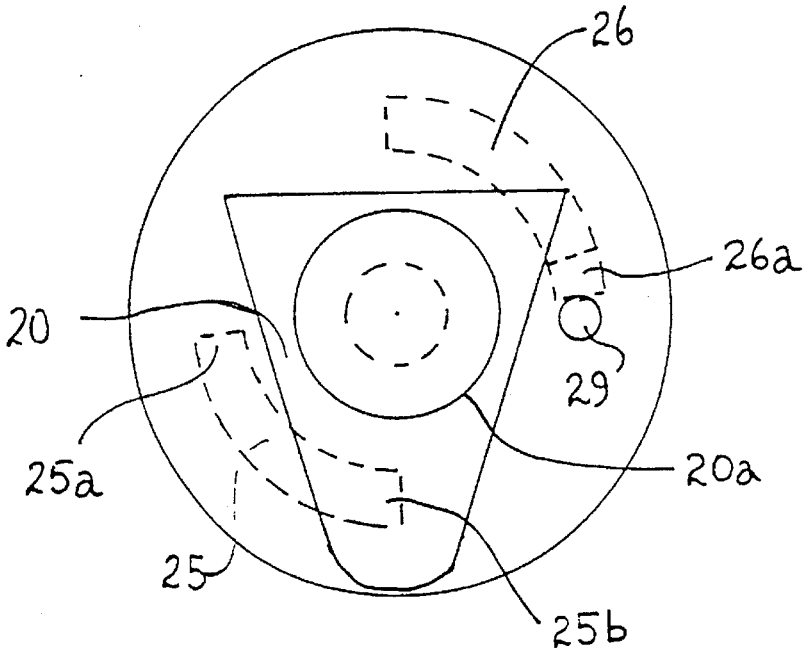
Figure 6:
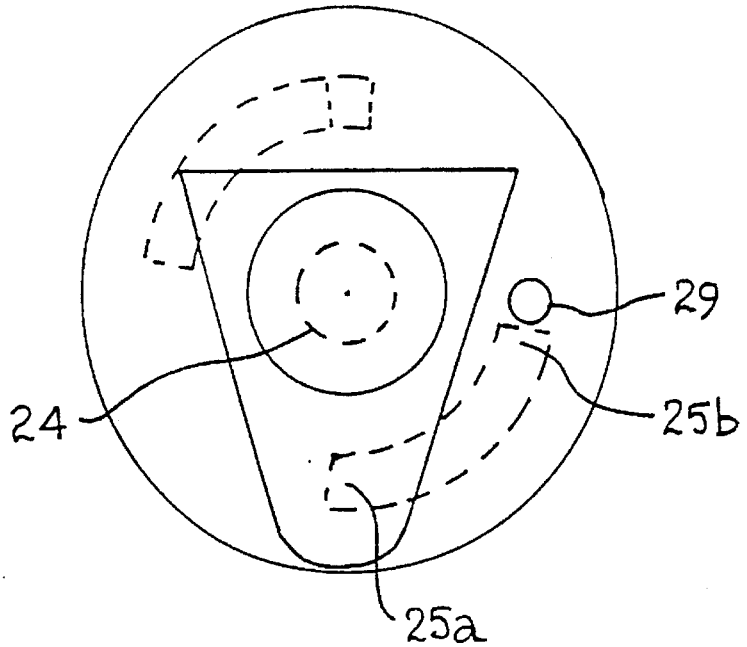

The arcuate cam 25 is of tapered depth increasing from a low depth at end 25*a* to a greater depth at end 25*b*. The cam 25 is of sufficient depth so that when the cap 13 is positioned on the body 12 and is moved into the closed position relative to the body 10 (as shown in FIGS. 1 and 5), the cam 25 cooperates with the back of the obturator head 18 to urge the head 18 (against the bias due to the resilience of the web 20) into the orifice 16 in the top 19 thereby thereby obturating and sealing the orifice 16. In the closed position of the cap 13, the cam 25 holds the head 18 in its orifice-closing position. The stop 29 abuts against a stop 26*a* at one end of the cam 26 to prevent rotation of the cap 13 in a counter clockwise direction as viewed in FIG. 5. When the cap 13 is turned relative to the body 12 through approximately 90° to the "open" position (as shown in FIGS. 2 and 6), the cam 25 breaks contact with the head 18. However, the second cam 26 which is of uniform depth of less height than the stop 26*a* contacts the end of the web 20 (see FIG. 6) in the vicinity of the hinge 21 and holds the stopper so that the obturator head 18 rests lightly on the edge of the orifice 16. In this position, the stopper closes the orifice 16 sufficiently to prevent the fluid contents of the container from being dispensed therethrough when the container is in its inverted in use position. However, when in this open position, squeezing of the walls of the container 11, or any other way of pressurising the contents of the container 11, causes an increase in pressure within the container so that the obturator head 18 is subjected to an opening force. Since the second cam 26 holding the stopper in an orifice-obturating position is spaced from the head 18 by almost the entire length of the web 20, the web 20 is resiliently deflected by the opening force acting on the head 18. Thus the head 18 is resiliently moved away from the orifice in opposition to the biasing force enabling the contents of the container 11 to be dispensed via orifice 16 into the void between the body 12 and the cap 13, and to be discharged through the outlet opening 24. As previously stated, the aperture 20*a* in the web 20 ensures that the container contents can be dispensed through the opening 24. When the squeezed walls of the container are released, the suction created as the walls assume their relaxed position and the resilience of the resiliently deflected web 20 cause the obturator head 18 to be moved into contact with the edge of the orifice 16 thereby effectively preventing the contents of the container 11 dripping through the orifice 16. To assist in the non-drip function, the outlet opening 24 is formed with an internal cylindrical flange 24*a* which is concentric with the opening 24 so as to provide a small reservoir when the container is held in its inverted, in use position.

To seal the container 11, the cap is rotated back to the closed position as shown in FIGS. 1 and 5 so as to urge the obturator head into tight engagement with the hole 16.

Although in the above example the cap is turnable relative to the body 12, it is to be understood that the cap could comprise a two-part cap, with one part slidable relative to the other part. In this case the slidable part would carry a linear cam means which contacts the stopper to urge the stopper into sealing engagement with the orifice when the cap is in the closed position. The cam means would need to be dimensioned so that it was of sufficient length, width, and depth to contact the head 18 in the closed position and to contact the web 20 in the vicinity of the hinge 21 when the sliding part is in the position where the cap is open.

It is to be understood that the contents of the container may be pressurised in different ways to squeezing the container in order to displace the stopper and discharge contents from the container. For example the container may be a rigid wall construction with a piston or movable end wall which, when pushed, decreases the volume of the container. Alternatively a plunger or pump action could be used to pressurise the container above a predetermined value to displace the stopper and discharge the contents. Ideally, the means for pressurising the container should act to create a slight suction to draw the stopper back into the orifice 16, to obturate the orifice 16, when the cap is in the open position.

It will be appreciated that an important feature of the invention is the provision on the movable cap 13 of a closure part (e.g. the cam means 25) which retains the stopper 17 in an orifice-sealing closed position when the cap is in its closed position but which is moved, so as not to prevent the stopper from allowing fluid to pass out of the orifice, when the cap 13 is moved to its open position. Ideally this closure part comprises a cam surface which acts to move the stopper into its orifice-sealing closed position, against resilient biasing urging the stopper away from its orifice-sealing position, on moving the cap into the closed position.

A further alternative embodiment (not shown) of the invention is provided by screw mounting the cap 13 on the body 12 so that on turning the cap 13 relative to the body 12 the cap 13 is screwed downwardly towards the body end wall 19 into its closed position and screwed upwardly away from the body end wall 19 into its open position. The cap 13 would be turned through less than 360°, typically about 90°, in moving between its open and closed positions. In this case, the movement of the cap 13 towards and away from the end wall 19 as the cap is rotated provides the camming action acting on the stopper 17. Suitable cam surfaces may be provided on the underside of the end wall 23 of the cap 13 for cooperation with the stopper 17 on turning of the cap relative to the body 12. A cam surface corresponding to the first cam 25 would be provided to act on the head 18 of the stopper. Such a cam surface need not have a "tapered depth" (as with the first cam 25) and could be of substantially even or of tapered depth depending on the screw thread angle for the cooperating screw-threaded cap and body parts. Indeed the cam surface could be formed by the flat, inner surface of the end wall 23. Although it is preferred for the cam surface to be of arcuate form, this is not essential—it being necessary for this cam surface to hold the head 18 in a sealing position in the orifice 16 when the cap is rotated into its closed position. A further cam surface (not shown) corresponding to the second cam 26 may also be provided to act on the web 20 of the stopper 17 at a position spaced from the head 18 and typically in the region where the web 20 joins the end wall 19. The cam surface corresponding to the second cam 26 acts in a similar manner to cam 26 and will typically have a tapered depth and will hold the stopper so that the head 18 rests lightly on the edge of the orifice 16 when the cap is rotated into its open position. In this condition, internal pressure within the container body (typically created by squeezing the container body) is able to cause contained material to flow through the orifice 16 forcing the stopper to resiliently flex open against a fulcrum provided by the cam surface corresponding to the second cam 26. Once again this cam surface is conveniently, but not necessarily, of arcuate form.

I claim:

1. A dispensing closure device for sealing engagement over the mouth of a container which, in use, contains a fluid to be dispensed, the closure device comprising a body which has an orifice through which the fluid may flow, a stopper positioned externally of the orifice, and an apertured cap which is movable relative to the body from a closed position to an open position, said stopper being positioned and dimensioned relative to the orifice so as to be operable to open and close the orifice, the cap having closure means which, in the closed position of the cap, retains the stopper in a closed position in sealing engagement with the orifice to prevent fluid being dispensed through the orifice, and which, in the open position of the cap, is positioned to enable displacement of the stopper out of a position obturating the orifice, so that fluid can be dispensed through the orifice, on increasing the fluid pressure within the container above a predetermined pressure, wherein the stopper is mounted on the body, and having biasing means resiliently biasing the stopper towards a position in which it does not stop the orifice and said closure means comprises cam means for acting on the stopper during movement of the cap into its closed position to urge the stopper into its orifice sealing position in opposition to the resilient biasing of said biasing means.

2. A closure device according to claim 1, in which the stopper is made of material which can be resiliently flexed.

3. A closure device according to claim 1, in which the stopper, when in use, is biased towards a position where it opens the orifice to enable fluid to be dispensed by increasing the pressure of the fluid within the container when the cap is in its open position.

4. A closure device according to claim 1, in which the stopper comprises an obturator head dimensioned and positioned relative to the orifice so as to be able to seal off the orifice when the cap is in the closed position, and the biasing means comprises at least one resiliently deflectable member connecting the obturator head to the body.

5. A closure device according to claim 4, in which the cam means comprises a first cam surface which contacts the head when the cap is moved into the closed position to urge the head into sealing engagement in the orifice, and a second cam surface which contacts said at least one resiliently deflectable member when the cap is in said open position to hold the stopper in a position where the head obturates the orifice but which enables the resiliently deflectable member to resiliently deflect and move the head out of contact with the orifice to open the orifice when the head is subjected to fluid pressure from within the container above a predetermined pressure.

6. A closure device according to claim 1, in which said body comprises a cylindrical part provided with means for fastening the body to the container and an end wall in which the orifice is located eccentrically relative to the longitudinal axis of the cylindrical part, the stopper being mounted on the end wall eccentrically relative to said longitudinal axis.

7. A closure device according to claim 6, in which the cap comprises a cylindrical wall portion and an end wall with an outlet opening therein.

8. A closure device according to claim 7, in which the end wall of the cap is provided with an internal annular wall concentric with the orifice.

9. A closure device according to claim 1 in which the cap is rotatable relative to the body between its open and closed positions.

10. A closure device according to claim 9, in which the body is cylindrical about the axis of rotation of the cap and is provided with a circumferentially extending groove, and in that the cap is cylindrical and has radially inwardly projecting means which engage the groove to hold the cap in place on the body.

11. A closure device according to claim 10, in which the radially inwardly projecting means comprises an annular flange.

12. A closure device according to claim 1, in which the cam means comprises at least one camming surface, for example of arcuate form, acting on the stopper on movement of the cap between its open and closed positions.

13. A closure device according to claim 1, in which cooperating stop means are provided on the cap and on the body to restrict the extent of movement of the cap relative to the body.

14. A closure device according to claim 1, in which the cap is slidable along an axis relative to the body from the open position to the closed position.

15. A closure device according to claim 1 in combination with a container, wherein the closure device is arranged for sealing engagement over the mouth of the container.

* * * * *